US005875646A

United States Patent [19]

Rich

[11] Patent Number: 5,875,646

[45] Date of Patent: Mar. 2, 1999

[54] DEVICE FOR COOLING FOOD AND BEVERAGES ESPECIALLY FOR AN INFANT

[76] Inventor: Tammy Rich, 490 El Camino Paraiso, Hollister, Calif. 95023

[21] Appl. No.: 92,754

[22] Filed: Jun. 5, 1998

[51] Int. Cl.[6] ..... F25D 3/08

[52] U.S. Cl. ..... 62/457.3

[58] Field of Search ..... 62/457.2, 457.3, 62/457.4, 530

[56] References Cited

U.S. PATENT DOCUMENTS

| | | | |
|---|---|---|---|
| 2,730,151 | 1/1956 | Smith . | |
| 4,292,817 | 10/1981 | Loucks . | |
| 4,311,022 | 1/1982 | Hall . | |
| 4,324,111 | 4/1982 | Edwards . | |
| 4,393,975 | 7/1983 | Moore | 206/385 |
| 4,441,336 | 4/1984 | Cannon . | |
| 4,470,264 | 9/1984 | Morris . | |
| 4,618,066 | 10/1986 | Vail | 215/12 R |
| 4,741,176 | 5/1988 | Johnson et al. | 62/457.4 |
| 4,877,128 | 10/1989 | Strickland . | |
| 5,329,778 | 7/1994 | Padamsee | 62/56 |
| 5,467,877 | 11/1995 | Smith | 215/11.1 |
| 5,555,746 | 9/1996 | Thompson | 62/457.4 |
| 5,573,141 | 11/1996 | Chen | 62/457.3 |

*Primary Examiner*—William C. Doerrler
*Attorney, Agent, or Firm*—Michael I. Kroll

[57] ABSTRACT

A device for cooling food and beverages includes an outer cylindrical body having an open bottom end and an open top end and at least one detent positioned a predetermined distance from both the open bottom side and open top side. An inner cylindrical shell having an inner side, an outer side, an open top end, an open bottom end, a first thread extending around the inner side of the top end and a second thread extending around the inner side of the bottom end. The inner cylindrical shell is connected at its open top end to the open top end of the outer cylindrical body to form a sleeve therebetween. A cooling producing element positioned within the sleeve formed between the outer cylindrical body and the inner cylindrical shell. A bottom cap having a protrusion extending from a central portion thereof and at least one clip extending from a periphery thereof. The protrusion has a thickness and a third thread extending around a periphery thereof for mating with the first thread, wherein the clip is received within the detent on the bottom end of the outer cylindrical body when the first and third threads are completely mated sealing the cooling producing element between the outer cylindrical body and the inner cylindrical shell. A top cap having a protrusion extending from a central portion thereof and at least one clip extending from a periphery thereof. The protrusion has a thickness and a fourth thread extending around a periphery thereof for mating with the second thread, wherein the clip is received within the detent on the bottom end of the outer cylindrical body when the second and fourth threads are completely mated.

12 Claims, 6 Drawing Sheets

Fig. 3
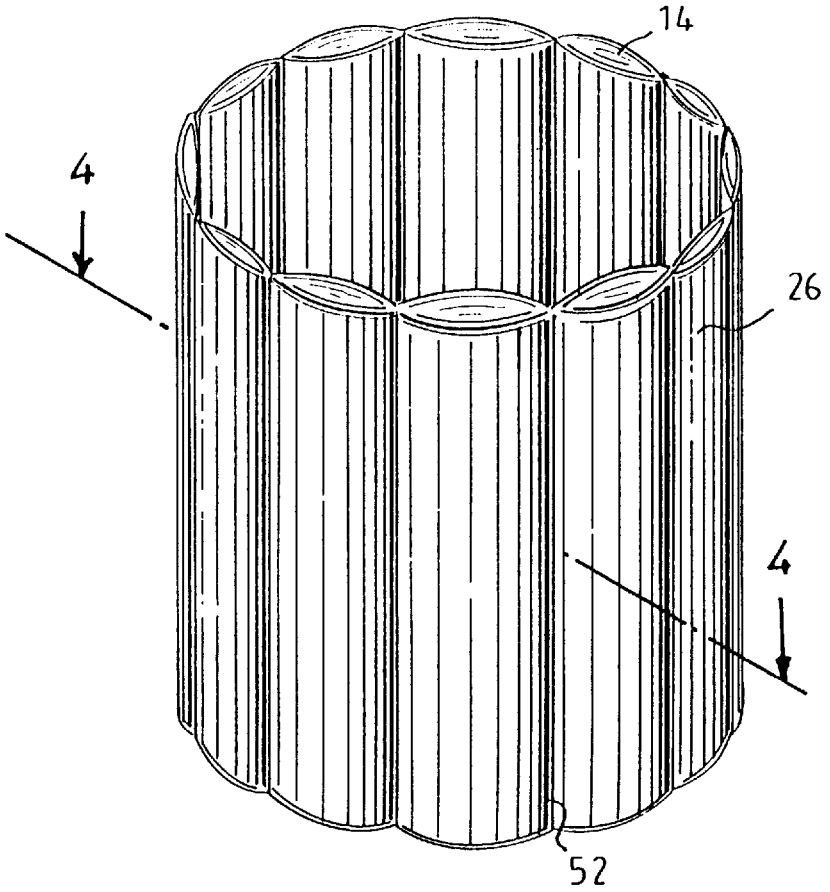
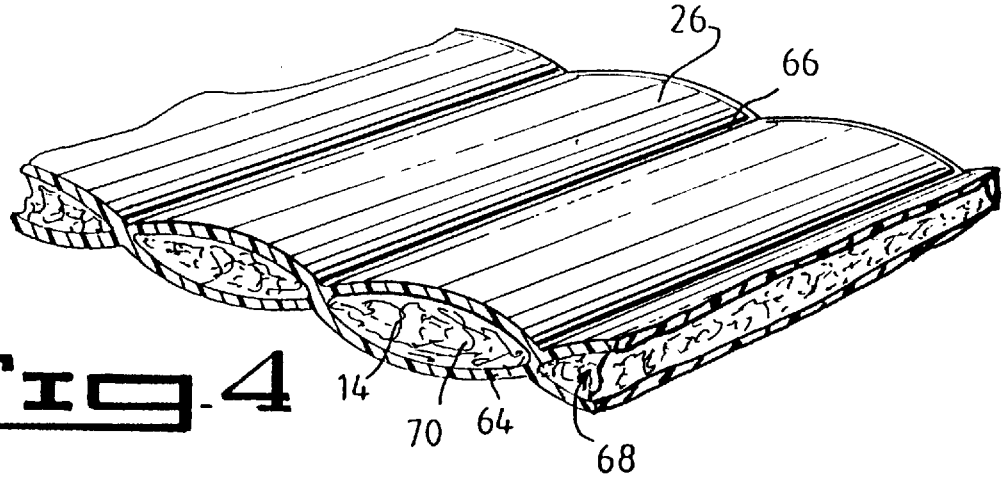
Fig. 4

DEVICE FOR COOLING FOOD AND BEVERAGES ESPECIALLY FOR AN INFANT

BACKGROUND OF THE INVENTION

1. Field of the Invention

The instant invention relates generally to coolers and, more specifically, to a device for cooling food and beverages especially for an infant.

2. Description of the Prior Art

Numerous devices for cooling food and drinks have been provided in prior art. For example, U.S. Pat. Nos. 4,292,817; 4,311,022; 4,324,111; 4,441,336; 4,470,264 and 4,877,128 all are illustrative of such prior art. While these units may be suitable for the particular purpose to which they address, they would not be as suitable for the purposes of the present invention as heretofore described.

U.S. Pat. No. 4,292,817

Inventor Terry L. Loucks

Issued Oct. 6, 1981

A controlled temperature shipping assembly is disclosed which comprises a container, a plurality of liquid retention members and temperature control means. The container includes both an outer protective layer and an inner insulating layer. The outer protective layer and the insulating layer define a shipping cavity containing the liquid retention members and the temperature control means. The liquid retention members are removably positioned in the shipping cavity such that at least one surface of each of the liquid retention members is in direct contact with at least one surface of the temperature control means. The temperature control means are positioned in the shipping cavity such that the temperature of each of the liquid retention members can be controlled below predetermined levels.

U.S. Pat. No. 4,311,022

Inventor John M. Hall

Issued Jan. 19, 1982

An ice pack which is constructed of a plurality of separate compartments which are connected together through a webbing assembly. Each of the compartments is movable in respect to each other permitting the ice pack to be located within confined various sizes of spaces. Within each compartment of the ice pack is located a quantity of freezable substance which is to be used as a refrigerant. Each compartment is enclosed by a wall assembly which retards the accumulation of moisture on the exterior surface of the wall assembly.

U.S. Pat. No. 4,324,111

Inventor William A. Edwards

Issued Apr. 13, 1982

Freezing gel containment structure is comprised of a plurality of adjacent tubes. The tubes are secured in adjacent edgewise relationship and each is separately filled with freezing gel. The tubes are tall and narrow and are sufficiently filled so that they have some cylindrical structural strength. The containment structure comprised of the plurality of tubes is strong enough to stand.

U.S. Pat. No. 4,441,336

Inventor John P. Cannon

Issued Apr. 10, 1984

A portable cooler has a hollow chest provided with a lid and with a lower food compartment as well as an upper food chamber used alternately depending upon the horizontal or vertical disposition of a capped bottle in the chest. Water in the bottle is initially frozen and beverage cans are then placed against concavities formed exteriorly of the bottle. Tabs on the ends of the bottle are either caused to slide within opposed grooves in the chest or laid on an upwardly-facing shoulder in the chest.

U.S. Pat. No. 4,470,264

Inventor Stanley D. Morris

Issued Sep. 11, 1984

A transportable self-contained life support apparatus steadily reduces in temperature whole blood collected from donors to a predetermined temperature range. The whole blood is kept live by maintaining the temperature of the blood within such range through conductive heat transfer to an adjacent coolant. The coolant, in a frozen state and having a freezing temperature just below the predetermined range, absorbs heat commensurate to/with its latent heat of fusion and precludes temperature excursion of the blood until all of the coolant has become liquid. Similarly, platelets, extracted from the blood, can be maintained at the predetermined temperature range during storage and transport. Over chilling is precluded by limiting the low temperature of the coolant to its freezing temperature and a life destroying temperature rise is self-evident by and can only occur after a complete change in the state of the coolant.

U.S. Pat. No. 4,877,128

Inventor E. L. McCain

Issued Apr. 9, 1918

A baby bottle caddy carrying container is set forth wherein the container is formed with an interior flexible matrix of four compartments formed of wall structure of a flexible, relatively thin first thickness spaced from an exterior wall surface of a second greater thickness. The spacing between the first and second wall structure provides for acceptance of containers of cooling medium therewithin. The relatively thin first wall structure accommodates bottles of complementary square cross-sectional configuration wherein the bottles positionable within the matrix of compartments provide rigidity to the carrying case and accommodates varying size bottles to vary the spacing between the first and second walls. A third wall shell structure is in surrounding relationship to provide strength and support to the carrying container of the instant invention.

SUMMARY OF THE INVENTION

The instant invention relates generally to coolers and, more specifically, to a device for cooling food and beverages especially for an infant.

A primary object of the present invention is to provide a device for cooling food and beverages that will overcome the shortcomings of the prior art devices.

Another object of the present invention is to provide device for cooling food and beverages including an internal cooling packet which can be separately frozen to remain cold for a long time and also used as an ice pack for minor bumps, bruises and bites.

An additional object of the present invention is to provide device for cooling food and beverages that is in the form of a training cup for infants and includes an insert sleeve containing a coolant to be frozen and thereby keep the beverage cold for an extended period of time.

A further object of the present invention is to provide device for cooling food and beverages in the form of a bottle carrier having an insert frame including a coolant to be frozen to keep baby bottles placed within the bottle carrier cool.

An even further object of the present invention is to provide a device for cooling food and beverages that is simple and easy to use.

A still further object of the present invention is to provide device for cooling food and beverages that is economical in cost to manufacture.

Further objects of the invention will appear as the description proceeds.

A device for cooling food and beverages includes an outer cylindrical body having an open bottom end and an open top end and at least one detent positioned a predetermined distance from both the open bottom side and open top side. An inner cylindrical shell having an inner side, an outer side, an open top end, an open bottom end, a first thread extending around the inner side of the top end and a second thread extending around the inner side of the bottom end. The inner cylindrical shell is connected at its open top end to the open top end of the outer cylindrical body to form a sleeve therebetween. A cooling producing element positioned within the sleeve formed between the outer cylindrical body and the inner cylindrical shell. A bottom cap having a protrusion extending from a central portion thereof and at least one clip extending from a periphery thereof. The protrusion has a thickness and a third thread extending around a periphery thereof for mating with the first thread, wherein the clip is received within the detent on the bottom end of the outer cylindrical body when the first and third threads are completely mated sealing the cooling producing element between the outer cylindrical body and the inner cylindrical shell. A top cap having a protrusion extending from a central portion thereof and at least one clip extending from a periphery thereof. The protrusion has a thickness and a fourth thread extending around a periphery thereof for mating with the second thread, wherein the clip is received within the detent on the bottom end of the outer cylindrical body when the second and fourth threads are completely mated.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become more fully appreciated as the same becomes better understood when considered in conjunction with the accompanying drawings, in which like reference characters designate the same or similar parts throughout the several views, and wherein:

FIG. 3 is a perspective view of the insert sleeve of the device for cooling food and beverages in accordance with the present invention;

FIG. 4 is a cross sectional perspective view taken along line 4—4 in FIG. 3, showing the coolant therein;

DESCRIPTION OF THE REFERENCE NUMERALS

Figure 1:
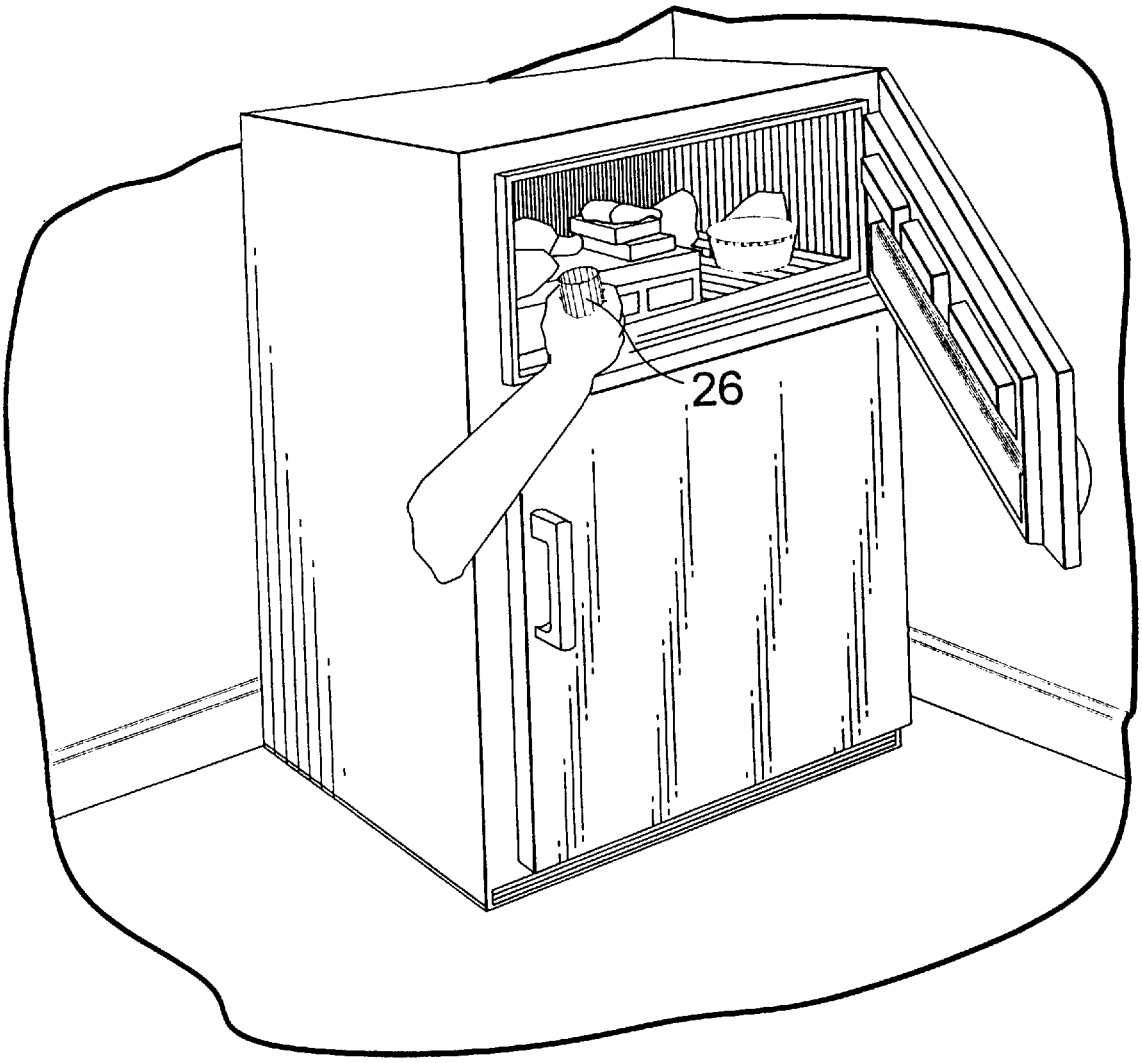
FIG. 1 is a perspective view showing an insert packet of the device for cooling food and beverages in accordance with the present invention being inserted into a freezer compartment of a refrigerator.

Turning now descriptively to the drawings, in which similar reference characters denote similar elements throughout the several views, the Figures illustrate a device for cooling food and beverages in accordance with the present invention. With regard to the reference numerals used, the following numbering is used throughout the various drawing figures.

| | |
|---|---|
| 10 | device for cooling food and beverages |
| 12 | drinking cup portion of device for cooling food and beverages |
| 14 | element producing cooling effect |
| 16 | outer cylindrical body of drinking training cup portion |
| 18 | open bottom end of outer cylindrical body |
| 20 | open top end of outer cylindrical body |
| 22 | inner cylindrical shell |
| 24 | cylindrical compartment |
| 26 | cylindrical sleeve |
| 28 | detent in bottom end of outer cylindrical body |
| 30 | bottom cap |
| 32 | clip extending from bottom cap |
| 34 | circular protrusion on top side of bottom cap |
| 36 | open bottom end of the inner cylindrical shell |
| 38 | spill proof lid |
| 40 | rubber or polymeric seal around bottom cap |
| 42 | drinking spout on spill proof lid |
| 44 | protrusion depending from spill proof lid |
| 46 | thread around protrusion depending from spill proof lid |
| 48 | top end of inner cylindrical shell |
| 50 | seal on spill proof lid |
| 52 | detent in top end of outer cylindrical body |
| 54 | clip extending from spill proof lid |
| 56 | inner side of inner cylidrical shell |
| 58 | internal thread on inner side of inner cylindrical shell |
| 60 | spill proof lid attaching component |
| 62 | thread spiraling around inner side of inner cylindrical shell |
| 64 | flexible plastic covering |
| 66 | longitudinal seal in the flexible plastic covering |
| 68 | chamber in the flexible plastic covering |
| 70 | cooling agent |

DETAILED DESCRIPTION OF THE PREFERRED EMBODIMENT

Turning now descriptively to the drawings, in which similar reference characters denote similar elements throughout the several views, FIGS. 1 to 6 illustrate a device for cooling food and beverages 10 especially for cooling a beverage for an infant's consumption. FIG. 1 shows a cylindrical sleeve 26 containing a cooling element 14 therein used with the device for cooling food and beverages 10 being placed within a freezer for cooling prior to the insertion of a food or beverage.

Figure 2:
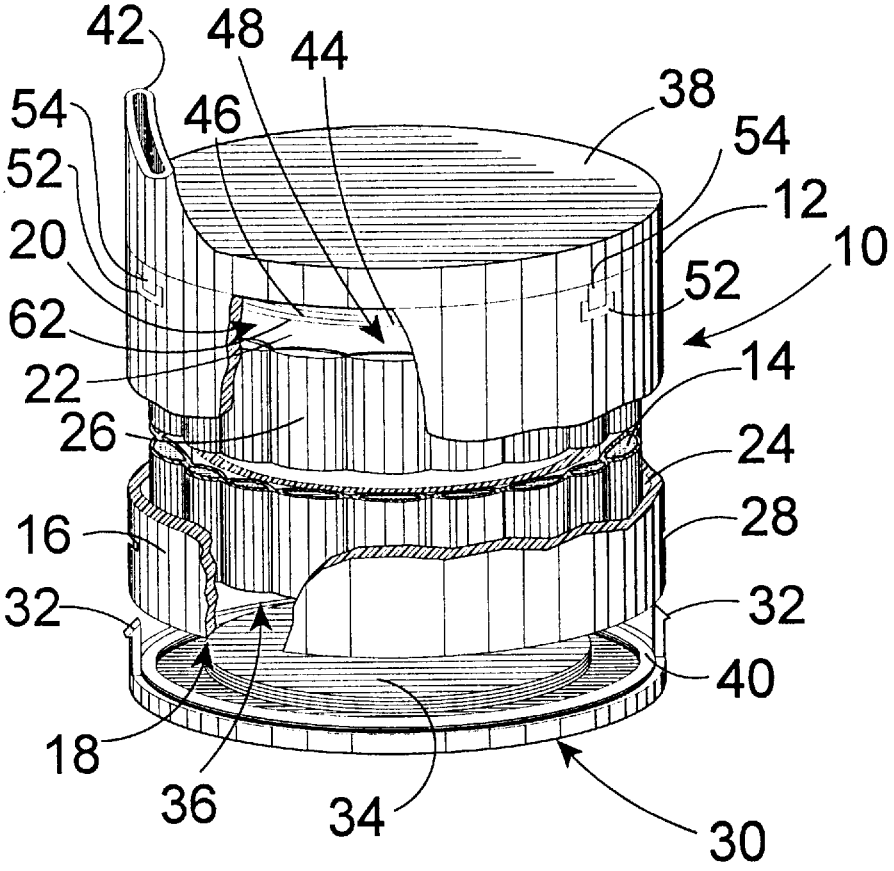
FIG. 2 is a partially exploded perspective view with parts broken away of the device for cooling food and beverages in accordance with the present invention.
Figure 5:
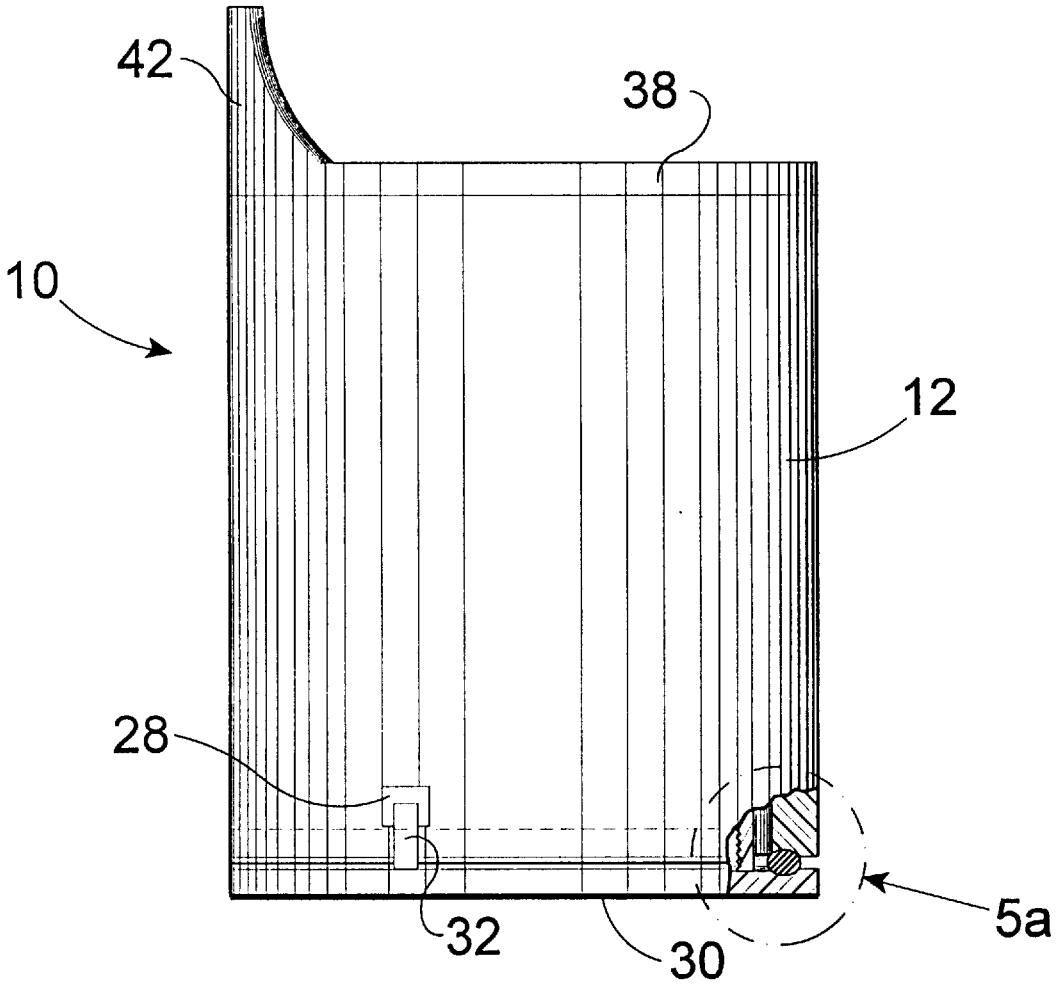
FIG. 5 is a side view of the training cup of FIG. 2.
Figure 5A:
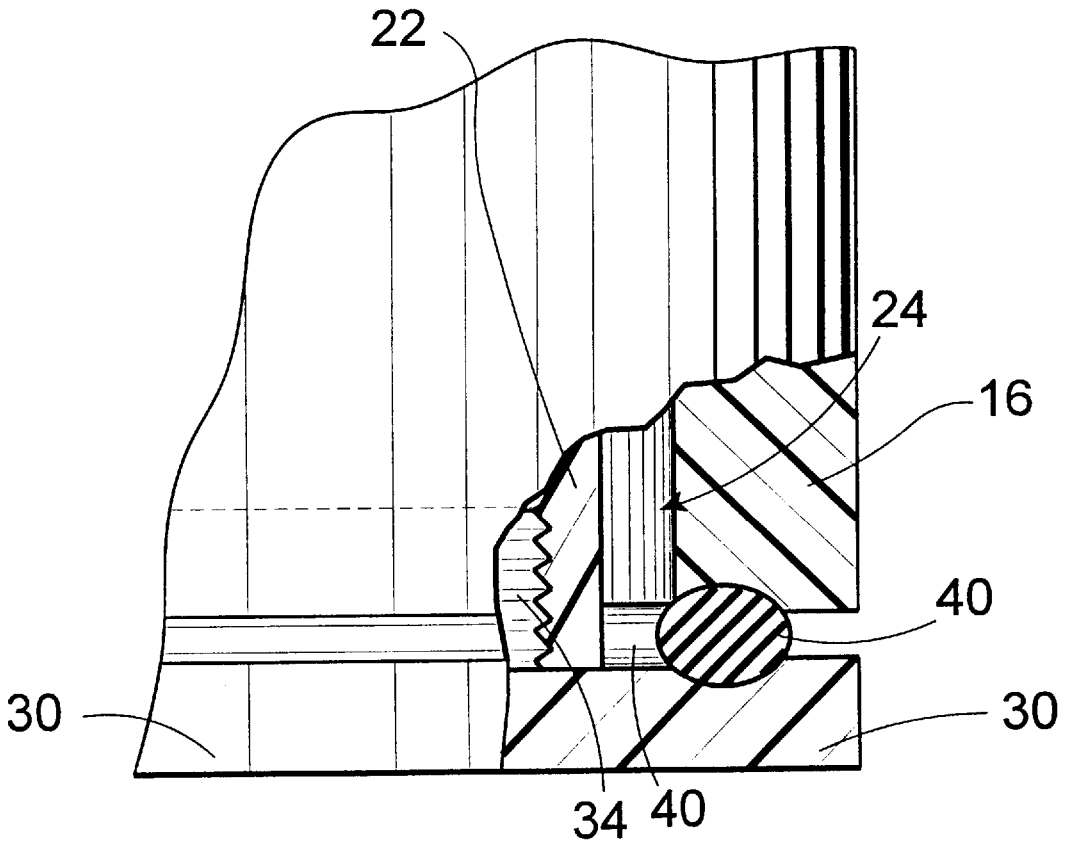
FIG. 5*a* is an enlarged view in partial cross-section of the base of the training cup within the circle labeled 5*a* in FIG. 5.

The device for cooling food and beverages 10 is clearly shown in FIG. 2 as a drinking training cup 12 having an element 14 therein for producing a cooling effect over a long period of time when frozen. When an infant drinks from the drinking training cup 12, the beverage placed therein will be cooled.

The drinking training cup 12 includes an outer cylindrical body 16 having an open bottom end 18 and an open top end 20. An inner cylindrical shell 22 is concentrically attached to the outer cylindrical body 16 at the open top end 20 to form a cylindrical compartment 24 therebetween. The cylindrical sleeve 26 as is clearly illustrated in FIGS. 3 and 4 includes the element 14 for producing a cooling effect over a long period of time when frozen positioned therein. The cylindrical sleeve 26 is removably inserted into the cylindrical compartment 24 between the outer cylindrical body 16 and the inner cylindrical shell 22. Around an outer side of the outer cylindrical body 16 are positioned a plurality of detents 28 for receiving a clip 32 extending from a bottom cap 30.

The bottom cap 30 is clearly illustrated in FIGS. 2, 5, 5*a* and 6. A circular protrusion 34 extends from a top side of the bottom cap 30 and is for attaching the bottom cap 30 to an open bottom end 36 of the inner cylindrical shell 22 in a removable manner. This will seal off the open bottom end 18 of the outer cylindrical body 16 so as to form a receptacle for the beverage. A seal 40 made of rubber or any other polymeric material is provided around the protrusion 34 for producing a leak proof seal around the open bottom end 18 of the outer cylindrical body 14 when the bottom cap 30 is attached to the drinking training cup 12. When the bottom cap 30 is attached to the open bottom end 36 of the inner cylindrical shell 22, the clips 32 extending from the bottom cap 30 are secured within the detents 28 on the outer cylindrical body 16 to provide a further more secure connection and assist in preventing an infant or child from removing the bottom cap 30. Alternatively, the detent 28 may be formed as a cylindrical slot extending around the bottom end 18 of the outer cylindrical body 16.

Figure 6:
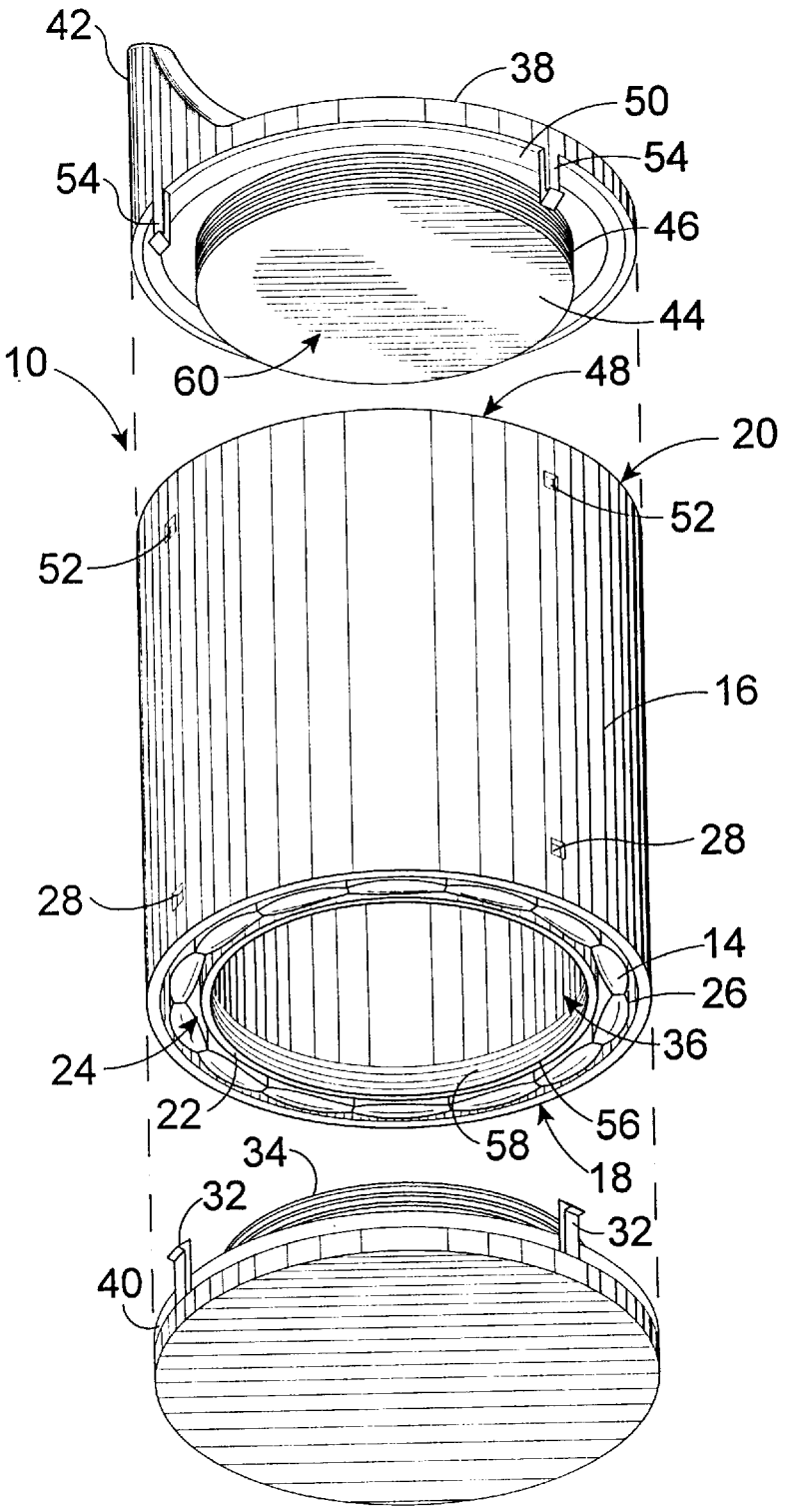
FIG. 6 is an exploded perspective view of the training cup of the device for cooling food and beverages in accordance with the present invention.

A spill proof lid 38 includes a drinking spout 42 as is illustrated in FIG. 6. A cylindrical protrusion 44 depends from the spill proof lid 38 and includes a thread 46 extending around an outer side thereof for attaching the spill proof lid 38 to a top end 48 of the inner cylindrical shell 38 in a removable manner. This will seal off the open top end 36 of the outer cylindrical body 32. A seal 50 made of rubber or any polymeric material is positioned around the protrusion 44 so as to fit between the inner cylindrical shell 22 and the spill proof lid 38 and thus prevent a liquid within the drinking training cup 12 from leaking. Furthermore, detents 52 similar to the detents 28 may be positioned about the open top end 20 of the outer cylindrical body 16 for mating with clips 54 extending from the spill proof lid 38 to further secure the spill proof lid 38 to the drinking training cup 12. Alternatively, the detent 52 may be formed as a cylindrical slot extending around the top end 20 of the outer cylindrical body 16. An infant can now drink from the drinking spout 42 without spilling the cool beverage and fear of the infant removing the spill proof lid 38.

The bottom cap attaching structure consists of the cylindrical protrusion 34 extending from a center of the bottom cap 30. The protrusion 34 includes a thread 40 extending around an external surface thereof and is concentrically formed on a top surface of the bottom cap 30. In order for the bottom cap 30 to close the open bottom end 18 of the outer cylindrical body 16, the protrusion 34 is threaded into the bottom end 36 of the inner cylindrical shell 22. An inner side 56 of the bottom end 36 of the inner cylindrical shell 22 includes a thread 58 spiraling therearound which mates with the thread 40 around the protrusion 34 to secure the bottom cap 30 to the cup 12. The clips 32 extending from the bottom cap 30 are received by the detents 28 in the outer cylindrical body 16.

The spill proof lid attaching component 60 includes the inner cylindrical shell 38 having the thread 62 extending around the inner side of the top end 48. The protrusion 44 including the thread 46 extending around the external side is provided. The protrusion 44 is concentrically formed on a bottom surface of the spill proof lid 34. The protrusion 44 is threaded into the top end 48 of the inner cylindrical shell 22. When the spill proof lid 38 is attached, the clips 54 extending therefrom are caused to be received by the detents 52 and further secure the spill proof lid 38 to the cup 12. This provides added security from removal of the spill proof lid 38 by a child or infant drinking therefrom.

The cylindrical sleeve 42, as best seen in FIGS. 3 and 4, contains a flexible plastic covering 64 having a plurality of longitudinal seals 66, to form a plurality of chambers 68 to store the cooling producing element 14 therein. The cooling producing element 14 is a coolant agent 70, such as BLUE ICE, which when frozen will stay cold over a period of time. Furthermore, each of the plurality of longitudinal seals 66 are connected to adjacent seals along a length thereof and are flexible with respect to each other. This allows the cylindrical sleeve 66 to adapt to a plurality of differing shapes to fit within a plurality of differently shaped areas not limited to that of the cylindrical compartment of the of the drinking training cup 12 shown in FIGS. 1, 2, 5 and 6.

In operation, the cylindrical sleeve 26 containing the cooling producing element 14 is placed in a freezer to cool. When the cylindrical sleeve 26 is sufficiently cool it is removed from the freezer and placed within the slot between the outer cylindrical body 16 and the inner cylindrical shell 22. The bottom cap 30 is then positioned at the open bottom end of the cup 12 and is turned in a clockwise direction causing the thread 40 spiraling around the protrusion 34 to mate with the thread 58 spiraling around the bottom end 56 of the inner cylindrical shell 22. When the threads 40 and 58 are in complete engagement, the clips 32 extending from the bottom cap 30 are received by the detents 28 in the outer cylindrical body 16 to create a secure locking engagement.

A beverage may now be poured into the cup 12. The cooled cylindrical shell 26 will act to cool the beverage for an extended period of time. The spill proof lid 38 may now be attached to the cup 12 for use by an infant or child. The spill proof lid 38 is positioned at the open top end 20 of the cup 12 and is turned in a clockwise direction causing the thread 46 spiraling around the protrusion 44 to mate with the thread 62 spiraling around the top end 48 of the inner cylindrical shell 22. When the threads 44 and 62 are in complete engagement, the clips 54 extending from the spill proof lid 38 are received by the detents 52 in the outer cylindrical body 16 to create a secure locking engagement. A child or infant may now drink a cooled beverage through the drinking spout 42 on the spill proof lid 38 without possibility of spilling.

Based upon the above description it is evident that the device for cooling food and beverages of the present invention will overcome the shortcomings of the prior art devices.

This device includes an internal cooling packet which can be separately frozen to remain cold for a long time and also used as an ice pack for minor bumps, bruises and bites and is in the form of a training cup for infants and includes an insert sleeve containing a coolant to be frozen and thereby keep the beverage cold for an extended period of time. The device for cooling food and beverages in also the form of a bottle carrier having an insert frame including a coolant to be frozen to keep baby bottles placed within the bottle carrier cool. Furthermore, the device for cooling food and beverages is simple and easy to use and economical in cost to manufacture.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A device for cooling food and beverages comprising:

a) an outer cylindrical body having an open bottom end and an open top end and at least one detent positioned a predetermined distance from both said open bottom side and said open top side;

b) an inner cylindrical shell having an inner side, an outer side, an open top end, an open bottom end, a first thread extending around said inner side of said top end and a second thread extending around said inner side of said bottom end, said inner cylindrical shell being positioned within and connected at said open top end to said open top end of said outer cylindrical body to form a sleeve therebetween;

c) a cooling producing element positioned between said outer cylindrical body and said inner cylindrical shell;

d) a bottom cap having a protrusion extending from a central portion thereof and at least one clip extending from a periphery thereof, said protrusion having a thickness and a third thread extending around a periphery thereof for mating with said first thread, wherein said clip is received within said detent on said bottom end of said outer cylindrical body when said first and third threads are completely mated sealing said cooling producing element between said outer cylindrical body and said inner cylindrical shell;

e) a top cap having a protrusion extending from a central portion thereof and at least one clip extending from a periphery thereof, said protrusion having a thickness and a fourth thread extending around a periphery thereof for mating with said second thread, wherein said clip is received within said detent on said bottom end of said outer cylindrical body when said second and fourth threads are completely mated.

2. A device for cooling food and beverages as recited in claim 1, wherein said cooling producing element is in the form of a cylindrical sleeve.

3. A device for cooling food and beverages as recited in claim 2, wherein said cooling producing element includes an outer shell, an inner shell and a cooling material positioned therebetween.

4. A device for cooling food and beverages as recited in claim 3, wherein said cooling producing element further includes plurality of longitudinally extending seals to form a plurality of pockets for storing said cooling element therein.

5. A device for cooling food and beverages as recited in claim 4, wherein said cooling element is a coolant agent which when frozen will stay cold over a long period of time.

6. A device for cooling food and beverages as recited in claim 1, wherein said top cap includes a drinking spout for preventing spills.

7. The device for cooling food and beverages as recited in claim 1, wherein said bottom cap further includes a means for sealing the food and beverages within said device.

8. The device for cooling food and beverages as recited in claim 1, wherein said means for sealing surrounds said protrusion extending from said bottom cap and engages said bottom end of said outer cylindrical body when said first and third threads are mated.

9. The device for cooling food and beverages as recited in claim 8, wherein said means for sealing is one of rubber or polymeric material or the like.

10. The device for cooling food and beverages as recited in claim 1, wherein said top cap further includes a means for sealing the food and beverages within said device.

11. The device for cooling food and beverages as recited in claim 10, wherein said means for sealing surrounds said protrusion extending from said top cap and engages said top end of said outer cylindrical body when said second and fourth threads are mated.

12. The device for cooling food and beverages as recited in claim 11, wherein said means for sealing is one of rubber or any other polymeric material.

* * * * *